US012466682B2

(12) United States Patent
Watanabe

(10) Patent No.: US 12,466,682 B2
(45) Date of Patent: Nov. 11, 2025

(54) SHEET PROCESSING DEVICE

(71) Applicant: Toshiba Tec Kabushiki Kaisha, Tokyo (JP)

(72) Inventor: Hiroaki Watanabe, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 18/643,983

(22) Filed: Apr. 23, 2024

(65) Prior Publication Data

US 2025/0136402 A1 May 1, 2025

(30) Foreign Application Priority Data

Nov. 1, 2023 (JP) ..... 2023-187591

(51) Int. Cl.

| | |
|---|---|
| ***B65H 31/02*** | (2006.01) |
| ***B65H 29/52*** | (2006.01) |
| ***B65H 45/18*** | (2006.01) |

(52) U.S. Cl.

CPC ..... *B65H 31/02* (2013.01); *B65H 29/52* (2013.01); *B65H 45/18* (2013.01); *B65H 2301/4213* (2013.01); *B65H 2301/42146* (2013.01); *B65H 2404/611* (2013.01); *B65H 2404/6942* (2013.01); *B65H 2515/81* (2013.01); *B65H 2801/27* (2013.01)

(58) Field of Classification Search

CPC .. B65H 31/02; B65H 2404/611; B65H 29/52; B65H 2301/4213; B65H 2301/42146; B65H 2404/6942

See application file for complete search history.

(56) References Cited

U.S. PATENT DOCUMENTS

| | | | | |
|---|---|---|---|---|
| 5,371,573 | A | 12/1994 | Kagaya et al. | |
| 9,346,648 | B2 * | 5/2016 | Osada | B65H 37/04 |
| 2015/0210503 | A1 | 7/2015 | Osada et al. | |

FOREIGN PATENT DOCUMENTS

| | | | |
|---|---|---|---|
| JP | 2021-147175 | A | 9/2021 |

OTHER PUBLICATIONS

Extended European Search Report dated Nov. 12, 2024 in EP Application No. 24175104.9, 8 pages.

* cited by examiner

*Primary Examiner* — Jeremy R Severson

(74) *Attorney, Agent, or Firm* — FOLEY & LARDNER LLP

(57) ABSTRACT

Provided is a sheet processing device that includes a guide, a support section, a stacker, and a gate. The guide is provided with a conveyance surface along a conveyance direction of a sheet. The support section is configured to form a conveyance path of the sheet together with the guide. The stacker is provided with a stack surface that supports a surface of the sheet conveyed through the conveyance path. The gate is configured to be able to receive the sheet into the stacker. The gate includes a first extension part and a second extension part. A plurality of first extension parts are disposed at intervals in a direction orthogonal to each of a normal direction of the stack surface and the conveyance direction. The second extension part is disposed to close spacing between two of the adjacent first extension parts in the orthogonal direction.

10 Claims, 8 Drawing Sheets

SHEET PROCESSING DEVICE

CROSS-REFERENCE TO RELATED APPLICATION

This application is based upon and claims the benefit of priority from Japanese Patent Application No. 2023-187591, filed on Nov. 1, 2023, the entire contents of which are incorporated herein by reference.

FIELD

Embodiments described herein relate generally to a sheet processing device.

BACKGROUND

The sheet processing device includes a guide, a support section, a stacker, and a gate. The guide has a conveyance surface along a conveyance direction of a sheet. The support section forms a conveyance path of the sheet together with the guide. The stacker has a stack surface that supports a surface of the sheet conveyed through the conveyance path. The gate is configured to be able to receive the sheet into the stacker. When a leading end of the sheet is caught by the gate when moving the sheet, there is a possibility that jam or the like of the sheet occurs.

DETAILED DESCRIPTION

Figure 1:
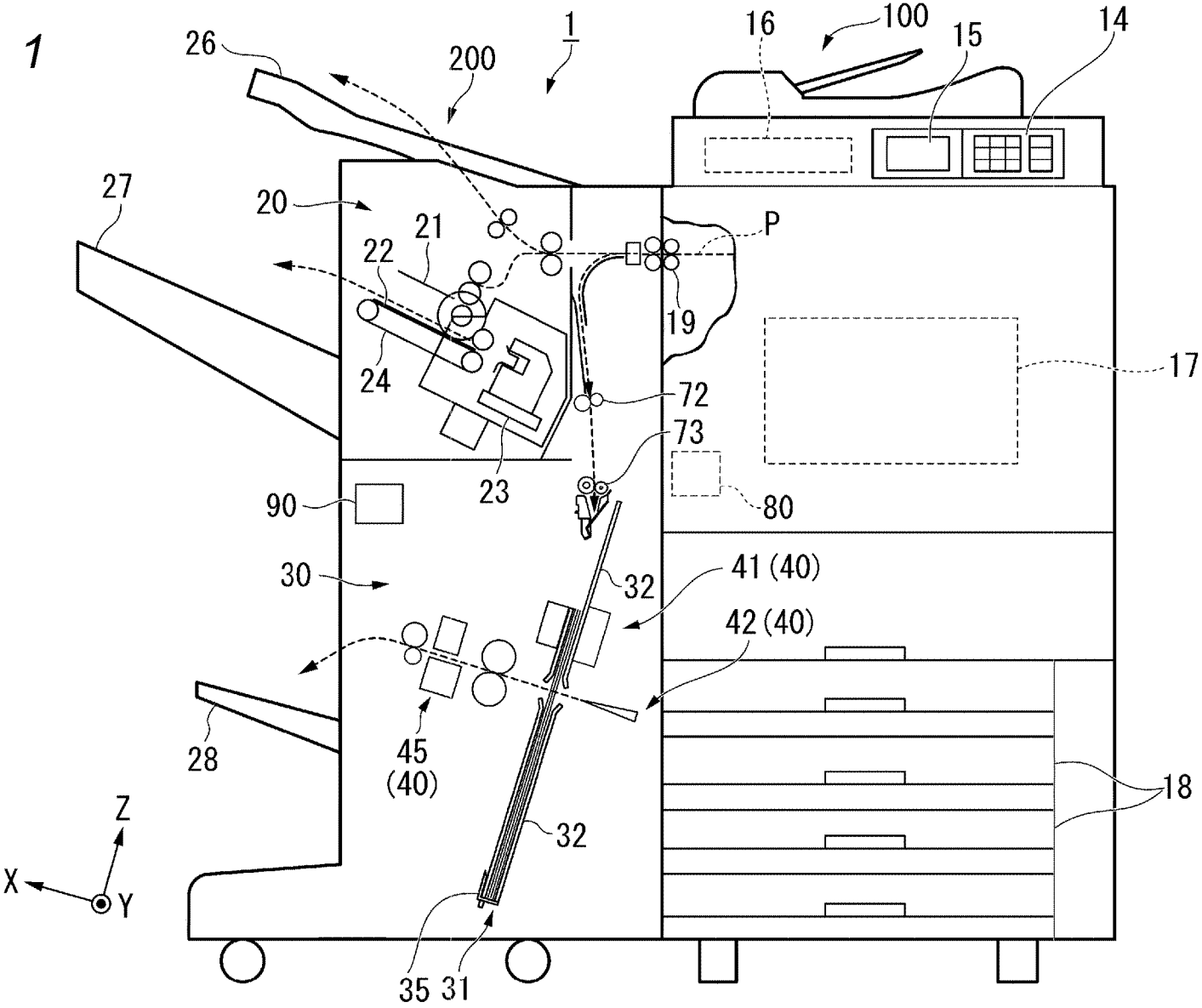
FIG. 1 is a schematic configuration diagram of an image forming apparatus of at least one embodiment.

Embodiments provide a sheet processing device capable of preventing a sheet from being caught during sheet movement.

In general, according to at least one embodiment, there is provided a sheet processing device that includes a guide, a support section, a stacker, and a gate. The guide is provided with a conveyance surface along a conveyance direction of a sheet. The support section is configured to form a conveyance path of the sheet together with the guide. The stacker is provided with a stack surface that supports a surface of the sheet conveyed through the conveyance path. The gate is configured to be able to receive the sheet into the stacker. The gate includes a first extension part and a second extension part. A plurality of first extension parts are disposed at intervals in a direction orthogonal to each of a normal direction of the stack surface and the conveyance direction. The second extension part is disposed so as to close spacing between two of the adjacent first extension parts in the orthogonal direction.

Hereinafter, a sheet processing device according to an embodiment will be described with reference to the drawings. In the following description, configurations having the same or similar functions are denoted by the same reference numerals. Further, redundant descriptions of these configurations may be omitted.

FIG. 1 is a schematic configuration diagram of an image forming apparatus 1 according to an embodiment. For example, the image forming apparatus 1 is disposed in a workplace. The image forming apparatus 1 includes an image forming apparatus main body 100 and a sheet processing device 200. The image forming apparatus main body 100 and the sheet processing device 200 are disposed adjacent to each other.

The image forming apparatus main body 100 will be described.

The image forming apparatus main body 100 forms an image on a sheet P (recording medium) using a recording agent. The sheet P is, for example, plain paper or label paper. A specific example of the recording agent is a toner. The toner is either a toner used as a decolorable recording agent or a toner used as a non-decolorable recording agent.

For example, the image forming apparatus main body 100 is a multifunction machine. As illustrated in FIG. 1, the image forming apparatus main body 100 includes a display unit 15, an operation unit 14, an image reading unit 16, a printer unit 17, a sheet storage unit 18, a paper discharge roller 19, and a first control unit 80.

The display unit 15 is an image display device such as a liquid crystal display or an organic electro luminescence (EL) display. The display unit 15 displays various information regarding the image forming apparatus main body 100 and the sheet processing device 200.

The operation unit 14 includes a plurality of buttons. The operation unit 14 receives an operation of a user. The operation unit 14 outputs a signal according to the operation performed by the user to the first control unit 80 of the image forming apparatus main body 100. The display unit 15 and the operation unit 14 may be configured as an integrated touch panel.

The image reading unit 16 reads image information to be read as the brightness and darkness of light. The image reading unit 16 outputs the read image information to the printer unit 17.

The sheet storage unit 18 stores the sheet P used for image formation. The sheet storage unit 18 supplies the stored sheet P to the printer unit 17.

The printer unit 17 forms an image on the sheet based on image information generated by the image reading unit 16 or image information received via a communication path. The printer unit 17 includes an image forming unit, a transfer unit, and a fixing device. The image forming unit forms an electrostatic latent image on a photoreceptor drum based on the image information. The image forming unit forms a visible image by attaching toner to the electrostatic latent image. The transfer unit transfers the visible image onto the sheet. The fixing device heats and pressurizes the toner to fix the visible image onto the sheet.

The paper discharge roller 19 is disposed near a paper discharge port of the image forming apparatus main body 100. The paper discharge roller 19 sends out the sheet P on which the image is formed to the sheet processing device 200.

Figure 2:
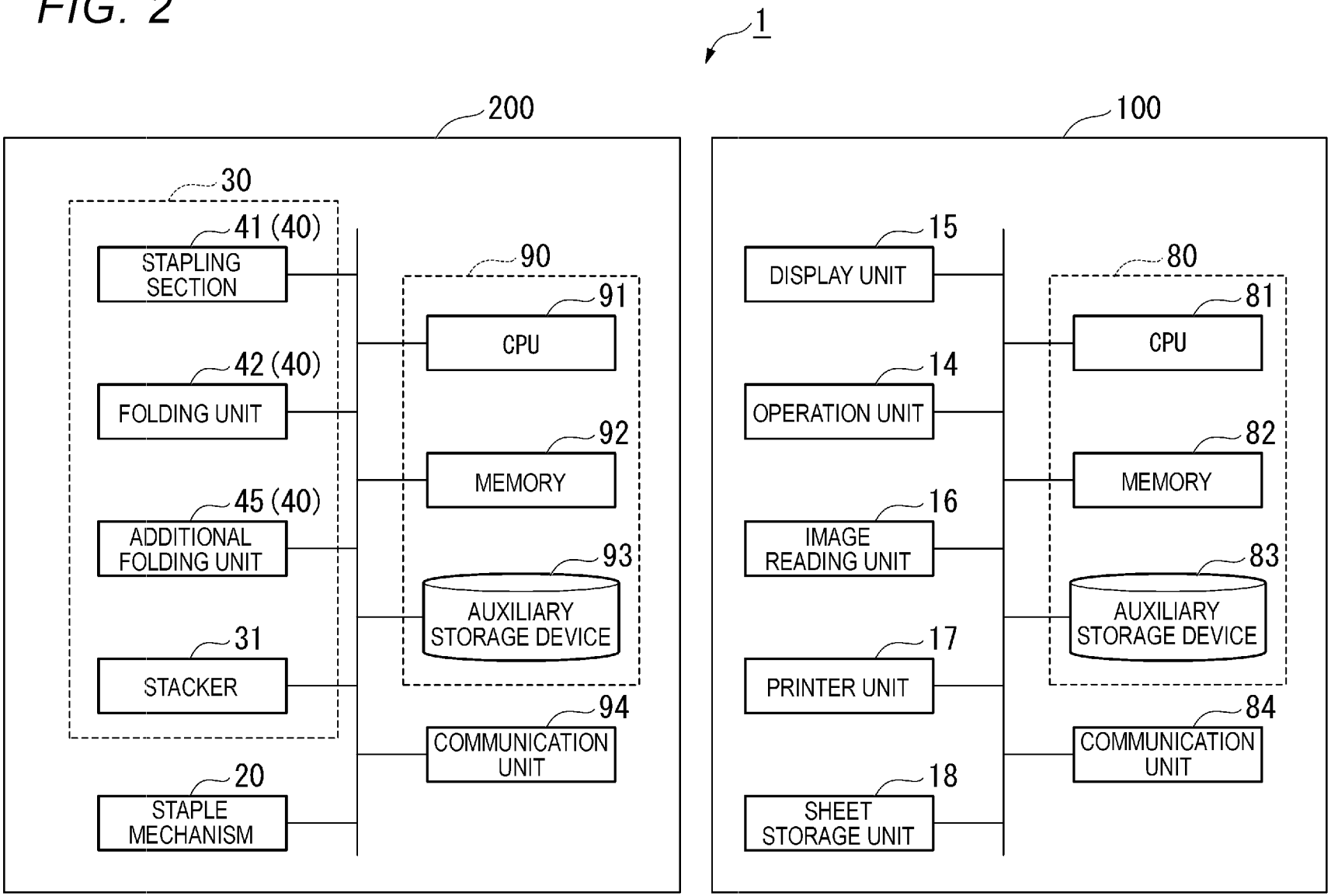
FIG. 2 is a block diagram illustrating an example of a functional configuration of the image forming apparatus.

FIG. 2 is a block diagram illustrating an example of a functional configuration of the image forming apparatus 1 of the embodiment. As illustrated in FIG. 2, the image forming apparatus main body 100 includes a central processing unit (CPU) 81, a memory 82, an auxiliary storage device 83, and the like that are connected via a bus. The image forming apparatus main body 100 functions as a device including the display unit 15, the operation unit 14, the image reading unit 16, the printer unit 17, the sheet storage unit 18, and a communication unit 84 by executing a program.

The CPU 81 functions as the first control unit 80 by executing programs stored in the memory 82 and the auxiliary storage device 83. The first control unit 80 controls the operation of each unit of the image forming apparatus main body 100 and the sheet processing device 200.

The auxiliary storage device 83 is configured to include a storage device such as a magnetic hard disk device or a semiconductor memory device. The auxiliary storage device 83 stores information.

The communication unit 84 is configured to include a communication interface for connecting its own device to an external device. The communication unit 84 communicates with the external device via the communication interface.

The sheet processing device 200 will be described.

As illustrated in FIG. 1, the sheet processing device 200 performs post-processing on the sheet P on which an image is formed. For example, the post-processing may be stapling or saddle folding. The sheet processing device 200 includes a staple mechanism 20, a saddle folding mechanism 30, and a second control unit (control unit) 90.

The staple mechanism 20 includes a standby tray 21, a processing tray 22, and a stapler 23. The stapler 23 performs stapling on peripheral edges of a plurality of sheets P. Hereinafter, the plurality of sheets P will be referred to as a sheet bundle. The stapled sheet P is conveyed by a conveyance belt 24. The sheet P conveyed by the conveyance belt 24 is discharged to a movable tray 27.

The sheet processing device 200 includes the movable tray 27, an upper tray 26, and a lower tray 28. The stapled sheet P is discharged to the movable tray 27. The sheet P that is not stapled is discharged to the upper tray 26. The lower tray 28 is located at a lower part of the sheet processing device 200. The sheet P processed by the saddle folding mechanism 30 is discharged to the lower tray 28.

Figure 3:
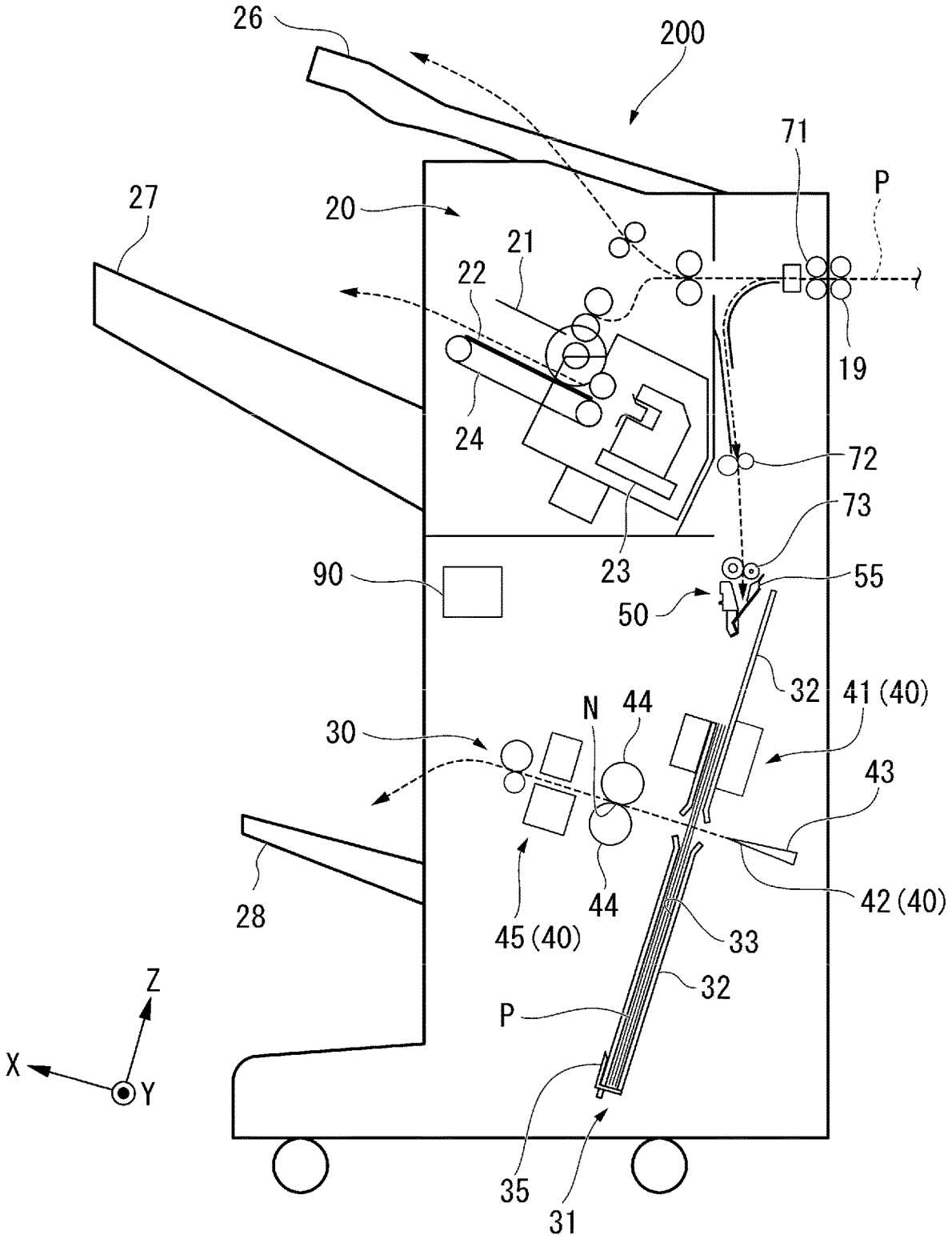
FIG. 3 is a schematic configuration diagram of a sheet processing device of at least one embodiment.

FIG. 3 is a schematic configuration diagram of the sheet processing device 200 of an embodiment. As illustrated in FIG. 3, the saddle folding mechanism 30 is provided at the lower part of the sheet processing device 200. The saddle folding mechanism 30 includes a stacker 31 and a post-processing section 40. The post-processing section 40 includes a stapling section 41, a folding unit 42, and an additional folding unit 45.

The stacker 31 is provided at a downstream end of the conveyance direction of the sheet P in the conveyance path of the sheet P. The sheet P is stacked on the stacker 31. The stacker 31 includes a bed 32 and a stacker main body 35. The bed 32 has a stack surface 33 that supports the surface of the sheet P.

As a local coordinate system of the saddle folding mechanism 30, the X-direction, Y-direction, and Z-direction of the orthogonal coordinate system are defined as follows. The X-direction is the normal direction of the stack surface 33 of the bed 32. The +X-direction is a direction in which the sheet P is placed on the bed 32. The +X-direction is a direction inclined upward relative to a horizontal direction. The Z-direction is the conveyance direction of the sheet P in the saddle folding mechanism 30. The −Z-direction is a direction in which the sheet P passes through the conveyance path and goes toward the stacker 31. The −Z-direction is a direction inclined downward relative to the horizontal direction. The Y-direction is the horizontal direction.

The bed 32 has an approximately plate shape. In the bed 32, the sheet P can be placed on the stack surface 33 facing in the +X-direction. The beds 32 are located on both sides in the Z-direction across the folding unit 42. The sheet P placed on the stack surface 33 is supported by the stacker main body 35. The stacker main body 35 supports a leading end in the −Z-direction of the sheet P conveyed to the stacker 31. The stacker main body 35 is movable along the Z-direction. For example, the stacker main body 35 is driven by a moving mechanism disposed in the −X-direction of the bed 32.

The stapling section 41 processes the sheet P at a position in the +Z-direction from a position where the sheet P is supported by the stacker main body 35. The stapling section 41 is located in the +Z-direction of the folding unit 42. The stapling section 41 performs stapling on the sheet P at a predetermined position. For example, the predetermined position of the sheet P is the center of the sheet P in the Z-direction.

The folding unit 42 processes the sheet P at a position in the +Z-direction from the position where the sheet P is supported by the stacker main body 35. The folding unit 42 folds the center portion of the sheet P in the Z-direction to give a fold on the sheet P. The folding unit 42 includes a pair of folding rollers 44 and a blade 43.

The pair of folding rollers 44 are located in the +X-direction of the bed 32. The pair of folding rollers 44 are aligned in the Z-direction. The rotation axes of the pair of folding rollers 44 extend in the Y-direction. The pair of folding rollers 44 are drive rollers. However, one of the pair of folding rollers 44 may be a driven roller. Each of the pair of folding rollers 44 is displaceable in the Z-direction. The pair of folding rollers 44 are displaced in the Z-direction so as to be able to approach and separate from each other. The displacements of the pair of folding rollers 44 in the Z-direction are interlocked with each other. The pair of folding rollers 44 come into contact with each other to form a nip N.

The blade 43 has a flat plate shape. The blade 43 is parallel to the XY plane. The blade 43 has a shape that tapers toward the +X-direction. The blade 43 is movable in the X-direction by passing between the beds 32 on both sides in the Z-direction. By pushing the sheet P into the nip N, the blade 43 cooperates with the pair of folding rollers 44 to form a fold extending in the Y-direction on the sheet P.

The additional folding unit 45 is located in the +X-direction of the pair of folding rollers 44. The additional folding unit 45 increases the number of folds of the sheet P.

For example, the saddle folding mechanism 30 can perform bookbinding on the sheet bundle. The bookbinding is processing in which stapling and saddle folding are performed on the sheet bundle stacked on the stacker 31.

In the bookbinding, the sheet bundle is first stapled. The stacker main body 35 moves the sheet bundle in the +Z-direction to make the center portion of the sheet bundle in the Z-direction coincide with the position of the stapling section 41. The stapling section 41 staples the sheet bundle.

Subsequently, saddle folding is performed on the stapled sheet bundle. The stacker main body 35 moves the sheet bundle in the −Z-direction to make the center portion of the sheet bundle in the Z-direction coincide with the position of the blade 43. The blade 43 moves in the +X-direction and pushes the center portion of the sheet bundle between the pair of folding rollers 44. The sheet bundle is saddle-folded at the center portion in the Z-direction. A fold extending in the Y-direction is formed on an end edge of the saddle-folded sheet bundle in the +X-direction. The additional folding unit 45 increases the number of folds of the sheet bundle. With the matters described above, the bookbinding of the sheet bundle is completed. The book-bound sheet bundle is discharged to the lower tray 28.

The saddle folding mechanism 30 can perform saddle folding on one or more sheets P stacked on the stacker 31 without stapling, instead of bookbinding. The one or more sheets P are one sheet P or sheet bundle. In this case, the stacker main body 35 directly conveys the one or more sheets P from a stack position to the folding unit 42. Thereafter, the fold is formed on the one or more sheets P at once in the same manner as saddle folding in the bookbinding. The sheet P on which the fold is formed is discharged to the lower tray 28.

As illustrated in FIG. 2, the sheet processing device 200 includes a central processing unit (CPU) 91, a memory 92, an auxiliary storage device 93, and the like that are connected via a bus. The sheet processing device 200 functions as a device including the staple mechanism 20, the saddle folding mechanism 30, and a communication unit 94 by executing a program.

The CPU 91 functions as the second control unit 90 by executing programs stored in the memory 92 and the auxiliary storage device 93. The second control unit 90 controls the operation of each unit of the sheet processing device 200.

The auxiliary storage device 93 is configured to include a storage device such as a magnetic hard disk device or a semiconductor memory device. The auxiliary storage device 93 stores information.

The communication unit 94 is configured to include a communication interface for connecting its own device to an external device. The communication unit 94 communicates with the external device via the communication interface.

The vicinity of a stack inlet gate in the sheet processing device 200 will be described.

Figure 4:
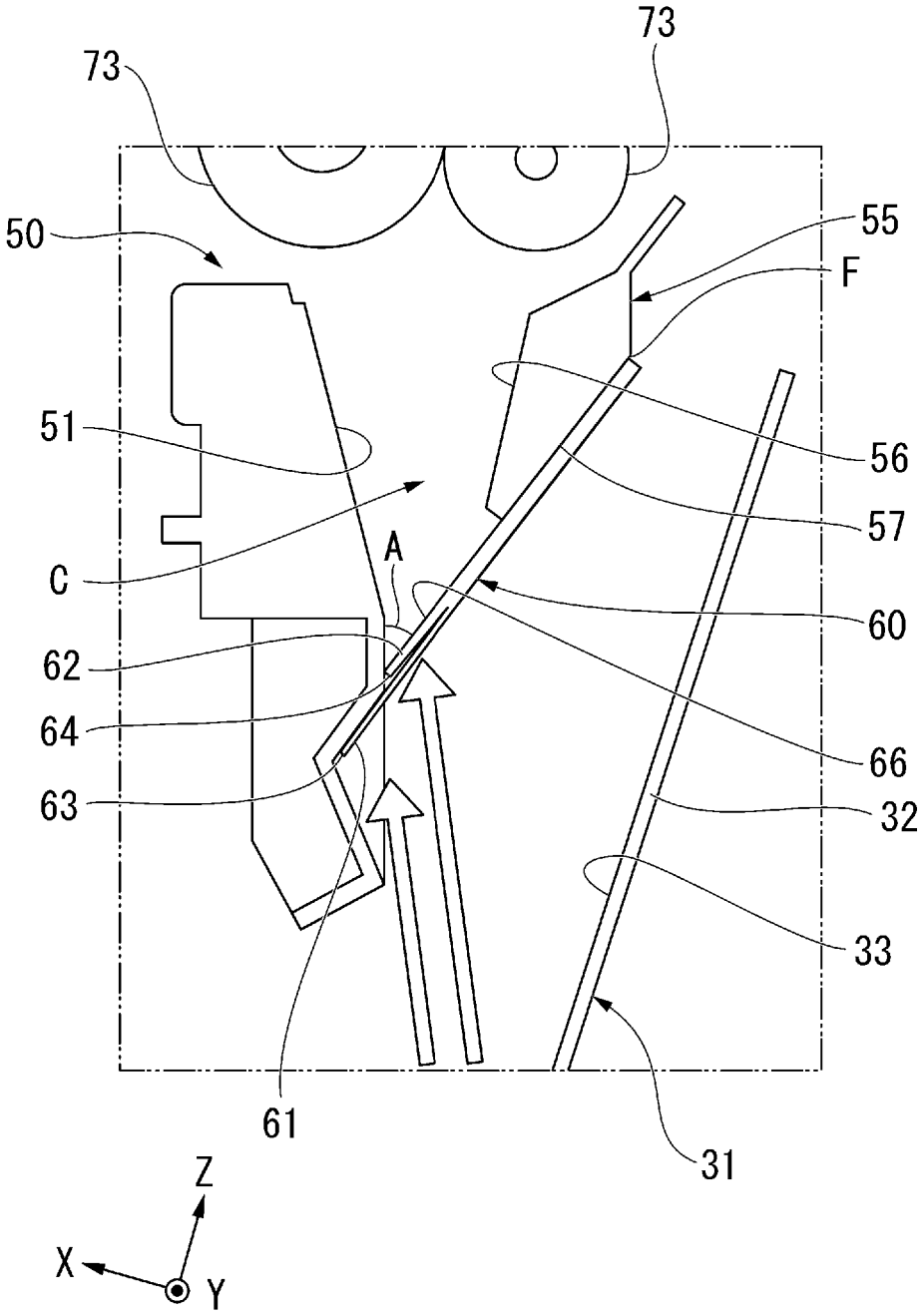
FIG. 4 is a schematic configuration diagram of the vicinity of a stack inlet gate in the sheet processing device.

FIG. 4 is a schematic configuration diagram of the vicinity of a stack inlet gate in the sheet processing device 200 of the embodiment. As illustrated in FIG. 4, the sheet processing device 200 includes a guide 50, a support section 55, the stacker 31, and a gate 60.

As illustrated in FIG. 3, the sheet processing device 200 includes a pair of first conveyance rollers 71, a pair of second conveyance rollers 72, and a pair of third conveyance rollers 73 upstream of the guide 50 in the conveyance direction of the sheet P. The sheet P sent out by the paper discharge roller 19 is conveyed by the pair of first conveyance rollers 71, the pair of second conveyance rollers 72, and the pair of third conveyance rollers 73 in this order. After the sheet P, which is conveyed by the pair of first conveyance rollers 71, the pair of second conveyance rollers 72, and the pair of third conveyance rollers 73 in this order, is curved toward the left side of the paper in FIG. 3, the sheet P moves obliquely toward the lower right side of the paper in FIG. 3. As illustrated in FIG. 4, the guide 50 is provided downstream of the pair of third conveyance rollers 73 in the conveyance direction of the sheet P.

The pair of third conveyance rollers 73 are aligned in the X-direction. The rotation axes of the pair of third conveyance rollers 73 extend in the Y-direction. The pair of third conveyance rollers 73 are drive rollers. However, one of the pair of third conveyance rollers 73 may be a driven roller.

The guide 50 is disposed directly below the third conveyance roller 73 which is in the +X-direction. The guide 50 is disposed in the +X-direction from the third conveyance roller 73, which is in the −X direction. The sheet P conveyed by the pair of third conveyance rollers 73 is directed toward the −Z-direction with respect to the guide 50.

The guide 50 has a conveyance surface 51 along the conveyance direction of the sheet P. The conveyance surface 51 is inclined so as to be located in the −X-direction as the conveyance surface 51 goes downward in the vertical direction when viewed from the Y-direction. When viewed from the Y-direction, the conveyance surface 51 is inclined so as to be located in the −X-direction as the conveyance surface 51 goes downward in the vertical direction from the upper end, and then is bent and extends downward in the vertical direction.

The support section 55 forms a sheet conveyance path C together with the guide 50. The support section 55 is disposed in th −X direction of the guide 50. The support section 55 is disposed directly below the third conveyance roller 73, which is in the −X direction.

The support section 55 has a facing surface 56 facing the guide 50. The facing surface 56 faces the conveyance surface 51 via the conveyance path C. The facing surface 56 is inclined so as to be located in the +X-direction as the facing surface 56 goes downward in the vertical direction when viewed from the Y-direction.

The support section 55 has a supporting surface 57 that supports the gate 60 on a side opposite to the facing surface 56. The supporting surface 57 is inclined so as to be in the +X-direction as the supporting surface 57 goes downward in the vertical direction when viewed from the Y-direction. The supporting surface 57 is inclined to form an acute angle with the facing surface 56 when viewed from the Y-direction. A combined shape of the facing surface 56 and the supporting surface 57 is a V-shape that projects toward the −Z-direction when viewed from the Y-direction.

The stacker 31 has the stack surface 33 that supports the surface of the sheet P conveyed through the conveyance path C. As illustrated in FIGS. 3 and 4, the stacker 31 includes the bed 32 and the stacker main body 35.

The bed 32 has the stack surface 33 that supports the surface of the sheet P conveyed through the conveyance path C.

The stacker main body 35 supports the leading end of the sheet P conveyed to the stacker 31 in the −Z-direction. The stacker main body 35 is movable along the Z-direction.

Next, the gate 60 will be described.

The gate 60 is configured to be able to receive the sheet P into the stacker 31. The gate 60 includes a first extension part 61 and a second extension part 62.

Figure 5:
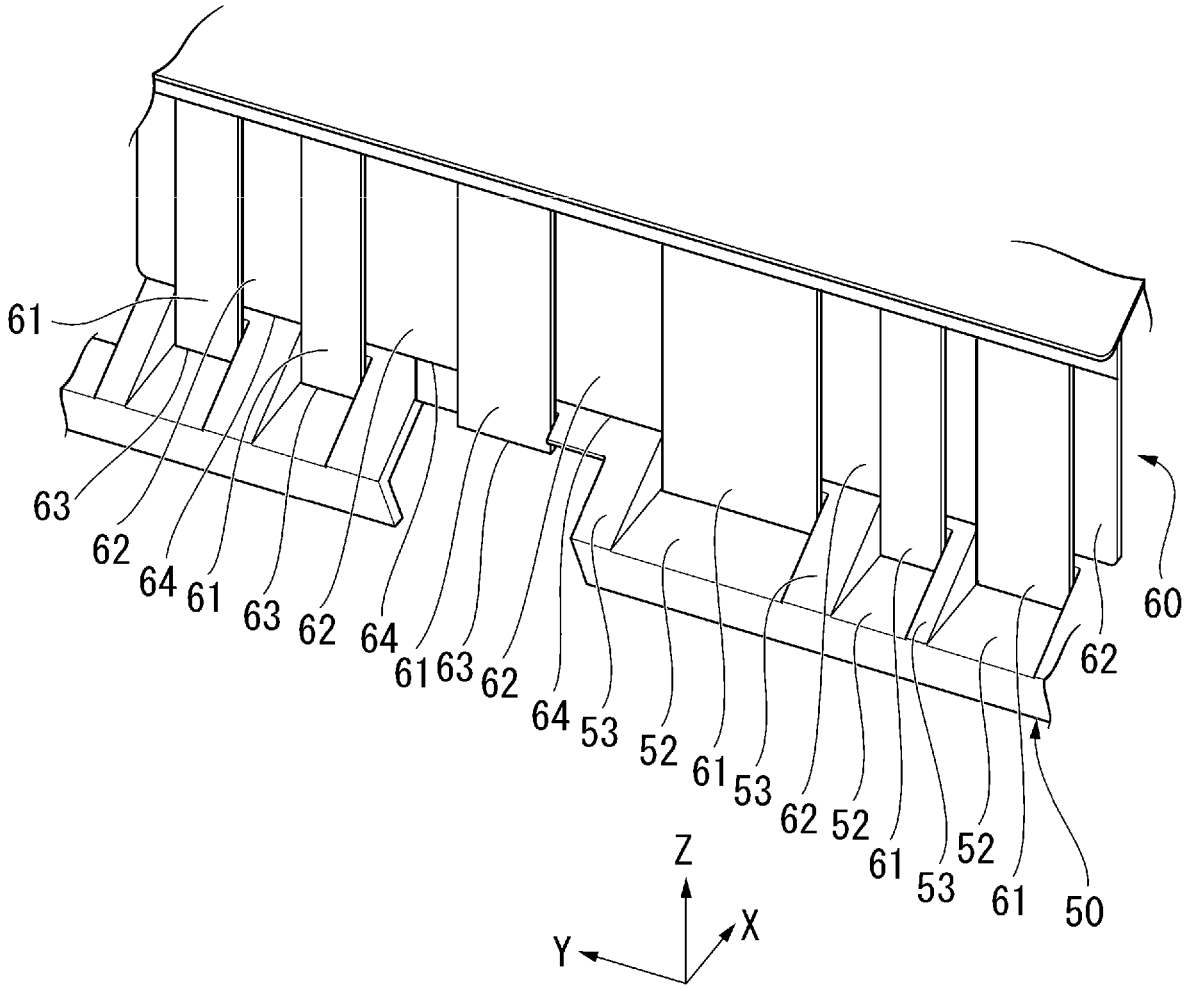
FIG. 5 is a perspective view illustrating a first extension part and a second extension part of a gate of the embodiment.

FIG. 5 is a perspective view illustrating the first extension part 61 and the second extension part 62 of the gate 60 of an embodiment. As illustrated in FIG. 5, a plurality of first extension parts 61 are disposed at intervals in a direction (hereinafter, also referred to as "Y-direction") orthogonal to each of the normal direction of the stack surface 33 and the conveyance direction. The second extension part 62 is disposed so as to close spacing between the two adjacent first extension parts 61 in the Y-direction.

Portions of each of the first extension part 61 and the second extension part 62 facing the conveyance path C are softer than portions thereof overlapping with the support section 55. The portions of each of the first extension part 61 and the second extension part 62 facing the conveyance path C are portions other than the portions of the first extension part 61 and the second extension part 62 that overlap with the guide 50 and the support section 55 when viewed from the vertical direction.

The first extension part 61 and the second extension part 62 are configured by disposing two portions having different lengths adjacent to each other in the Y-direction. The two portions having different lengths are disposed alternately in the Y-direction.

One of the two portions having different lengths (hereinafter, also referred to as "first extension part 61") overlaps with an end part of the conveyance surface 51 when viewed from the stack surface 33, and has a leading end 63 downstream in the conveyance direction. The other of the two portions having different lengths (hereinafter, also referred to as "second extension part 62") has a leading end 64 upstream of the one thereof in the conveyance direction when viewed from the stack surface 33.

The respective leading ends 63 of the plurality of first extension parts 61 may be at the same position in the Z-direction. The respective leading ends 64 of a plurality of second extension parts 62 may be at the same position in the Z-direction.

The plurality of first extension parts 61 (six extension parts in the example of FIG. 5) are disposed at intervals in the Y-direction. The plurality of first extension parts 61 may have mutually different lengths in the Y-direction. The plurality of second extension parts 62 (seven extension parts in the example of FIG. 5) are disposed at intervals in the Y-direction. The plurality of second extension parts 62 may have mutually different lengths in the Y-direction.

The guide 50 may have a concave portion 52 into which the leading end 63 of the first extension part 61 enters. The length of the concave portion 52 in the Y-direction may be the same as the length of the first extension part 61 in the Y-direction. The guide 50 may have a convex portion 53 between the two first extension parts 61 adjacent to each other in the Y-direction. The length of the convex portion 53 in the Y-direction may be the same as the interval between the two first extension parts 61 adjacent in the Y-direction.

As illustrated in FIG. 4, the conveyance surface 51 and the stack surface 33 are inclined toward each other as the surfaces 51 and 33 go downward in the vertical direction when viewed from the Y-direction. The conveyance surface 51 is inclined so as to be located in the −X direction as the conveyance surface 51 goes downward in the vertical direction when viewed from the Y-direction. The stack surface 33 is inclined so as to be located in the +X-direction as the stack surface 33 goes downward in the vertical direction when viewed from the Y-direction.

Each of the first extension part 61 and the second extension part 62 is formed of a resin material. Each of the first extension part 61 and the second extension part 62 is formed into a film shape. Each of the first extension part 61 and the second extension part 62 has flexibility. For example, the first extension part 61 and the second extension part 62 may have the same thickness. For example, each of the first extension part 61 and the second extension part 62 may have a thickness of 0.1 mm or more and 0.5 mm or less.

Each of the first extension part 61 and the second extension part 62 extends along the supporting surface 57 when viewed from the Y-direction. A portion of the second extension part 62 facing the conveyance path C is disposed above the first extension part 61 in the vertical direction.

The first extension part 61 and the second extension part 62 are supported at a position F farther from the conveyance path C than an end part facing the conveyance path C of the support section 55. For example, each of the first extension part 61 and the second extension part 62 is fixed at the upper end position F of the supporting surface 57.

When viewed from the Y-direction, an angle A formed between a contact surface 66 where the second extension part 62 contacts the sheet P and the conveyance surface 51 is 30 degrees or less. The angle A is an angle formed between the contact surface 66 of the second extension part 62 facing the conveyance path C and the surface of the conveyance surface 51 that extends along the vertical direction, when viewed from the Y-direction. The angle (contact angle) formed between the contact surface 66 of the second extension part 62 and the sheet P passing through the conveyance path C may be 30 degrees or less, when viewed from the Y-direction.

Next, an action due to the supporting state of the first extension part 61 and the second extension part 62 in the support section 55 will be described.

Figure 6:
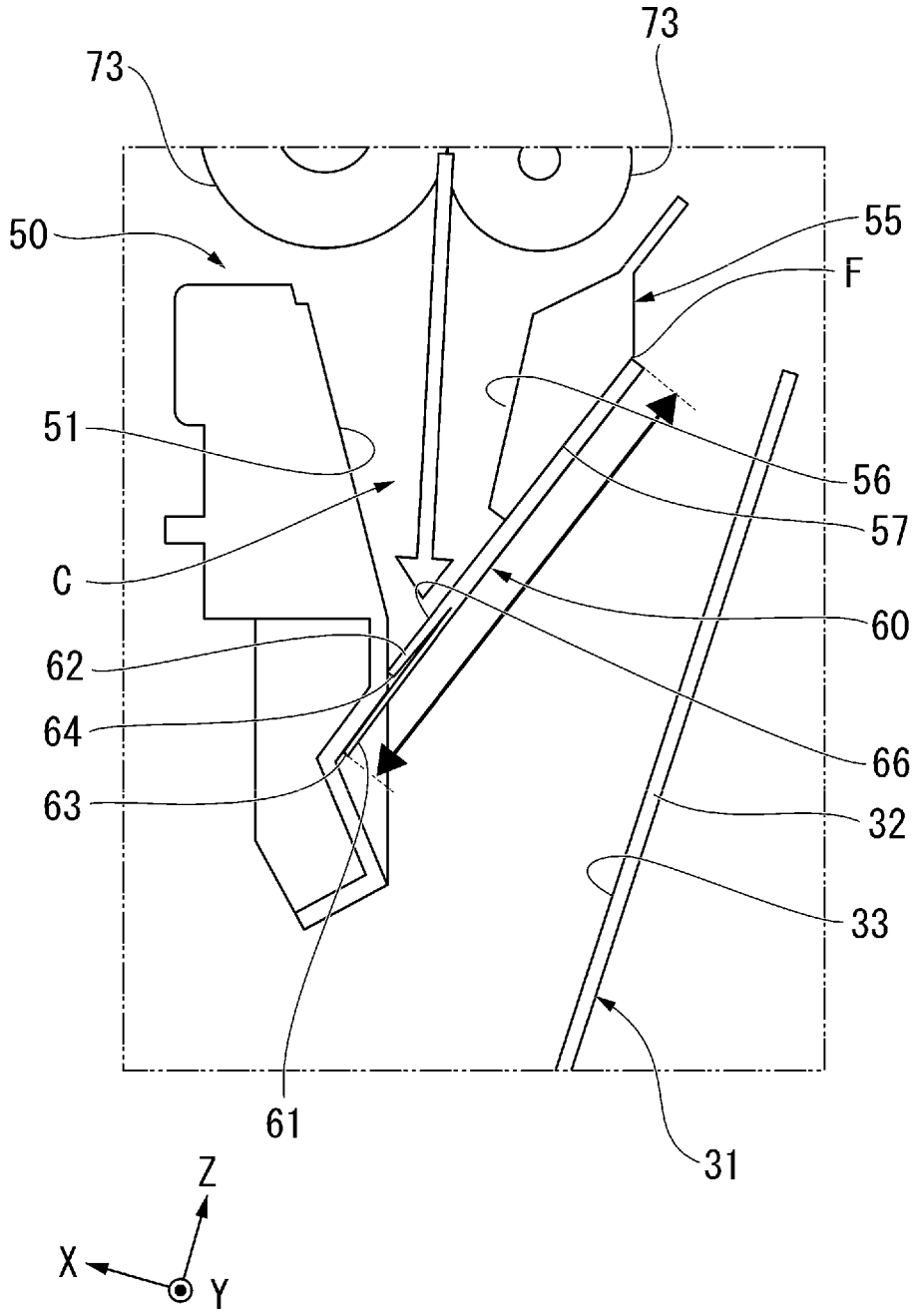
FIG. 6 is a first action explanatory diagram according to a supporting state of the first extension part and the second extension part in a support section.
Figure 7:
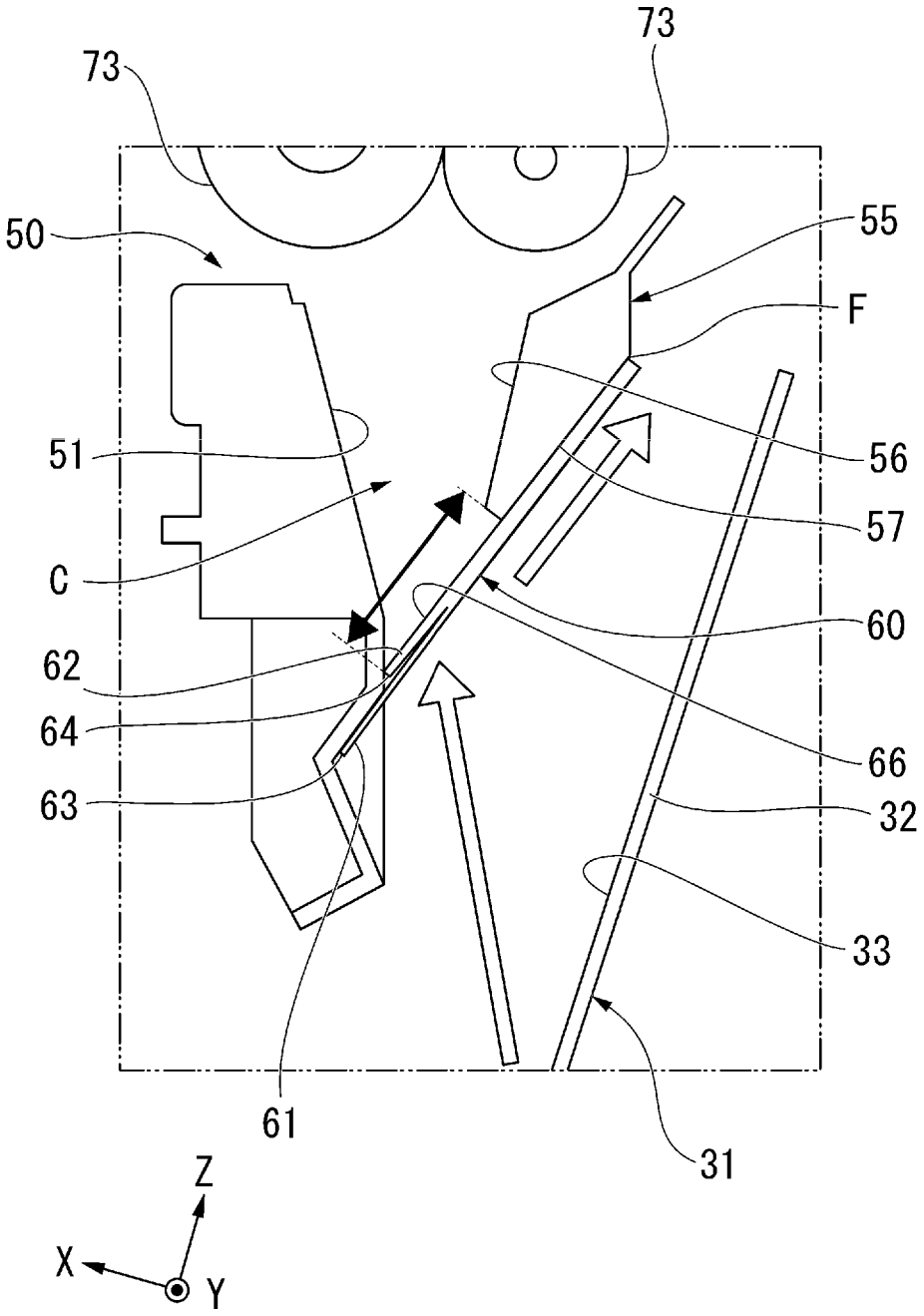
FIG. 7 is a second action explanatory diagram according to the supporting state of the first extension part and the second extension part in the support section.

FIG. 6 is a first action explanatory diagram due to the supporting state of the first extension part 61 and the second extension part 62 in the support section 55 of the embodiment. FIG. 7 is a second action explanatory diagram due to the supporting state of the first extension part 61 and the second extension part 62 in the support section 55 of the embodiment.

As illustrated in FIG. 6, when the sheet P moves from a conveyance path C side to a stacker 31 side, a portion of the first extension part 61 and the second extension part 62 can be bent from the upper end position F of the supporting surface 57 to a position facing the conveyance path C. In FIG. 6, the white arrow indicates the direction in which the sheet P moves from the conveyance path C side to the stacker 31 side and the black arrow indicates a range in which the first extension part 61 and the second extension part 62 can be bent (corresponding to the distance between the leading end 63 of the first extension part 61 and an end part fixed at the upper end position F).

As illustrated in FIG. 7, when the sheet P moves from the stacker 31 side to a conveyance path C side, the portions of the first extension part 61 and the second extension part 62 facing the conveyance path C can be bent. In FIG. 7, the white arrow on the lower side of the page indicates the direction in which the sheet P moves from the stacker 31 side to the conveyance path C side, the white arrow on the upper side of the paper indicates the direction in which the sheet P moves along the first extension part 61 and/or the second extension part 62, and the black arrow indicates a range in which the first extension part 61 and the second extension part 62 can be bent (corresponding to the distance between the leading end 64 of the second extension part 62 and a lower end position of the supporting surface 57).

As illustrated in FIGS. 6 and 7, when the sheet P moves from the conveyance path C side to the stacker 31 side, the first extension part 61 and the second extension part 62 are easily bent to a large extent compared to when the sheet P moves from the stacker 31 side to the conveyance path C side. Next, position control of the stacker 31 will be described. Position control (movement control) of the stacker 31 is performed by the second control unit 90.

For example, the sheet P moving from the conveyance path C side to the stacker 31 side enters from the diagonally above the left side of the paper in FIG. 3 (+X-direction and +Z-direction when viewed from the Y-direction). For example, the second control unit 90 may move the stacker main body 35 in the −Z-direction so that a trailing end of the sheet P entering the stacker 31 does not come into contact with the gate 60. For example, the stacker main body 35 may wait at a first position and receive the sheet P. The received sheet P is supported on the stack surface 33 of the bed 32. Hereinafter, the sheet supported on the stack surface 33 will also be referred to as "stacked paper."

For example, when creating a booklet with two or more folds, the second control unit 90 may move the stacker main body 35 in the +Z-direction so that the leading end of the second and subsequent sheet P comes into contact with the abdomen of the stacked paper (center side in the Z-direction). For example, the second control unit 90 may move the stacker main body 35 in the +Z-direction so that the leading end of the second and subsequent sheet P comes into contact with a portion below an upper end of the stacked paper. For example, the stacker main body 35 may wait at a second position located in the +Z-direction from the first position and receive the second and subsequent sheet P. The second and subsequent received sheets P are stacked on top of the stacked paper.

For example, when receiving the second and subsequent sheet P, the second control unit 90 may lower the stacker main body 35 to the first position after the leading end of the second and subsequent sheet P enters below the upper end of the stacked paper. Thereafter, the second control unit 90 may raise the stacked paper to the second position after the trailing end of the incoming sheet P passes through the gate 60. With this configuration, the next sheet P can be received while preventing the occurrence of jam or the like of the sheet P.

The sheet processing device 200 of the embodiment includes the guide 50, the support section 55, the stacker 31, and the gate 60. The guide 50 has the conveyance surface 51 along the conveyance direction of the sheet P. The support section 55 forms the conveyance path C of the sheet P together with the guide 50. The stacker 31 has the stack surface 33 that supports the surface of the sheet P conveyed through the conveyance path C. The gate 60 is configured to be able to receive the sheet P into the stacker 31. The gate 60 includes the first extension part 61 and the second extension part 62. The plurality of first extension parts 61 are disposed at intervals in the Y-direction orthogonal to each of the normal direction of the stack surface 33 and the conveyance direction. The second extension part 62 is disposed so as to close spacing between the two adjacent first extension parts 61 in the Y-direction. For example, when there is a gap between the two first extension parts 61 adjacent in the Y-direction, there is a high possibility that the leading end of the sheet P will enter the gap when the sheet P is moved and be caught on the end part of the first extension part 61 exposed in the gap. In contrast, in the embodiment, since spacing between the two first extension parts 61 adjacent to each other in the Y-direction is closed by the second extension part 62, there is a low possibility that the leading end of the sheet P will be caught on the end part of the first extension part 61 when the sheet P is moved. Therefore, the sheet can be prevented from being caught during sheet movement.

Portions of each of the first extension part 61 and the second extension part 62 facing the conveyance path C are softer than portions thereof overlapping with the support section 55. With this configuration, even though the leading end of the sheet hits the first extension part 61 and/or the second extension part 62 when receiving the sheet P from the conveyance path C side into the stacker 31, the portions facing the conveyance path C can be opened by a light force. Therefore, the conveyance resistance when the sheet enters from the conveyance path C side can be reduced.

The first extension part 61 and the second extension part 62 are configured by disposing two portions having different lengths adjacent to each other in the Y-direction. With this configuration, even though the leading end of the sheet hits the first extension part 61 and/or the second extension part 62, the portion of the first extension part 61 and/or the second extension part 62 that the leading end of the sheet hits is easily bent compared to when two portions having the same length are disposed adjacent to each other in the Y-direction. In addition, even though parts around the gate 60 have unevenness, the first extension part 61 and the second extension part 62 can be disposed along the uneven portion.

One of the two portions having different lengths overlaps with the end part of the conveyance surface 51 when viewed from the stack surface 33, and has the leading end 63 downstream in the conveyance direction. The other of the two portions having different lengths has the leading end 64 upstream of the one thereof in the conveyance direction when viewed from the stack surface 33. For example, when both of the two portions having different lengths have leading ends upstream in the conveyance direction with respect to the end part of the conveyance surface 51 when viewed from the stack surface 33, there is a high possibility that the leading end of the sheet P will be caught on the end part of the conveyance surface 51 when the sheet P moves from the stacker 31 side to the conveyance path C side. In contrast, in the embodiment, since one of the two portions having different lengths overlaps with the end part of the conveyance surface 51 when viewed from the stack surface 33 and includes the leading end 63 downstream in the conveyance direction, even though the sheet P moves from the stacker 31 side to the conveyance path C side, there is a low possibility that the leading end of the sheet P will be caught on the end part of the conveyance surface 51. Therefore, the sheet P can be prevented from being caught. In addition, even though the leading end of the sheet P comes into contact with one of the two portions having different lengths when the sheet P moves from the stacker 31 side to the conveyance path C side, the sheet P can be moved along the one thereof. In FIG. 4, two white arrows indicate the direction in which the sheet P moves from the stacker 31 side to the conveyance path C side.

The conveyance surface 51 and the stack surface 33 are inclined so as to approach each other as the surfaces 51 and 33 go downward in the vertical direction when viewed from the Y-direction. With this configuration, even though the sheet P is moved downward in the vertical direction along the inclination of the conveyance surface 51 or the sheet P is moved in the vertical direction along the inclination of the stack surface 33, the sheet P can be prevented from being caught.

Each of the first extension part 61 and the second extension part 62 is formed of a resin material. With this configuration, the flexibility of at least one of the first extension part 61 and the second extension part 62 is easily secured compared to when each of the first extension part 61 and the second extension part 62 is formed of a metal material. Therefore, even though the leading end of the sheet hits the first extension part 61 and/or the second extension part 62 during sheet movement, the sheet P can be easily moved without being caught by bending the portion of the first extension part 61 and/or the second extension part 62 that the leading end of the sheet hits.

The first extension part 61 and the second extension part 62 are supported at the position F farther from the conveyance path C than the end part facing the conveyance path C of the support section 55. With this configuration, the first extension part 61 and the second extension part 62 are easily bent to a large extent compared to when the first extension part 61 and the second extension part 62 are supported at the end part facing the conveyance path C in the support section 55. Therefore, even though the leading end of the sheet hits the first extension part 61 and/or the second extension part 62 during sheet movement, the sheet P can easily be moved without being caught by bending the portion of the first extension part 61 and/or the second extension part 62 that the leading end of the sheet hits.

When viewed from the Y-direction, the angle A formed between the contact surface 66 where the second extension part 62 contacts the sheet P and the conveyance surface 51 is 30 degrees or less. With this configuration, compared to when the formed angle A exceeds 30 degrees, the occurrence of jam or the like is easily prevented.

Figure 8:
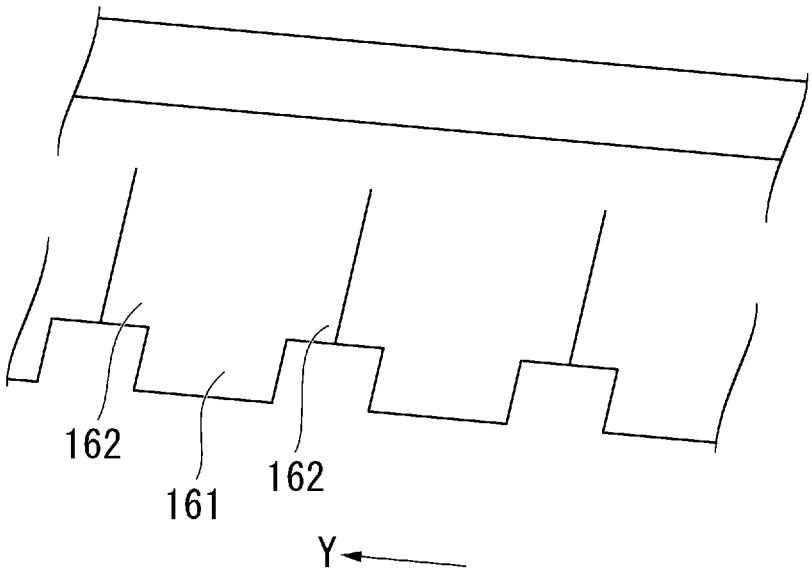
FIG. 8 is a perspective view illustrating a first extension part and a second extension part of a first modification.

Next, modifications of the embodiment will be described. FIG. 8 is a perspective view illustrating a first extension part 161 and a second extension part 162 of a first modification.

For example, as illustrated in FIG. 8, the first extension part 161 and the second extension part 162 may be integrally formed of the same member. With this configuration, the number of parts can be reduced compared to when the first extension part 161 and the second extension part 162 are made of different parts. For example, the formation mode of the first extension part 161 and the second extension part 162 can be changed according to design specifications.

Figure 9:
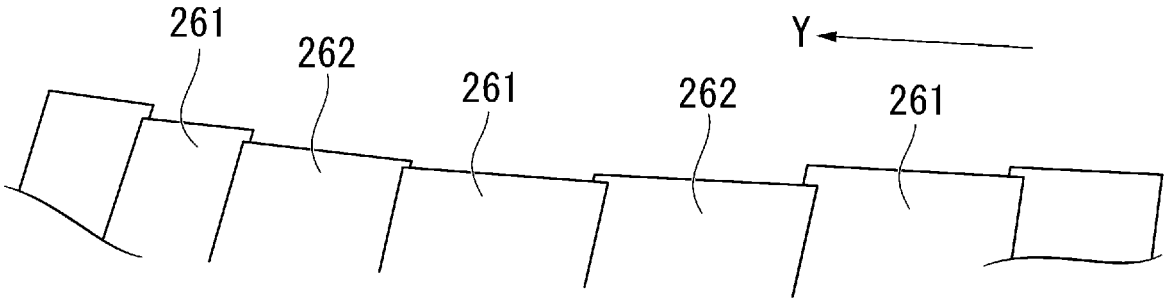
FIG. 9 is a perspective view illustrating a first extension part and a second extension part of a second modification.

FIG. 9 is a perspective view illustrating a first extension part 261 and a second extension part 262 of a second modification.

For example, as illustrated in FIG. 9, the first extension part 261 and the second extension part 262 may be disposed such that end edges thereof in the Y-direction overlap with each other when viewed from the conveyance direction of the sheet P. With this configuration, there is a low possibility that the leading end of the sheet P will be caught on the end edge of the first extension part 261 and/or the second extension part 262 when moving the sheet P. Therefore, the sheet can be prevented from being caught during sheet movement. For example, the disposition mode of the end edges of the first extension part 261 and the second extension part 262 in the orthogonal directions can be changed according to design specifications.

The portion facing the conveyance path of each of the first extension part and the second extension part of the embodiment is softer than a portion thereof overlapping with the support section. In contrast, the portion of each of the first extension part and the second extension part facing the conveyance path may be harder than the portion thereof overlapping with the support section. For example, a portion of at least one of the first extension part and the second extension part facing the conveyance path may be softer than a portion thereof overlapping with the support section. For example, the flexibility of the portion of each extension part facing the conveyance path can be changed according to design specifications.

The first extension part and the second extension part of the embodiment are configured by disposing two portions having different lengths adjacent to each other in an orthogonal direction. In contrast, the first extension part and the second extension part may be configured by disposing two portions having the same length adjacent to each other in the orthogonal direction. For example, the disposition mode of the first extension part and the second extension part can be changed according to design specifications.

One of the two portions having different lengths in the embodiment overlaps with the end part of the conveyance surface when viewed from the stack surface and includes the leading end downstream in the conveyance direction. The other of the two portions having different lengths has the leading end upstream of the one of the two portions in the conveyance direction when viewed from the stack surface. In contrast, both of the two portions having different lengths may have leading ends upstream in the conveyance direction with respect to the end part of the conveyance surface when viewed from the stack surface. For example, the positional relationship of the leading end of each portion with respect to the end part of the conveyance surface when viewed from the stack surface can be changed according to design specifications.

The conveyance surface and the stack surface of the embodiment are inclined so as to approach each other as the conveyance surface and the stack surface go downward in the vertical direction when viewed from the orthogonal direction. In contrast, the conveyance surface and the stack surface may be inclined so as to approach each other as the conveyance surface and the stack surface go upward in the vertical direction when viewed from the orthogonal direction. For example, the conveyance surface and the stack surface may be disposed in parallel to each other when viewed from the orthogonal direction. For example, the disposition mode of the conveyance surface and the stack surface when viewed from the orthogonal direction can be changed according to design specifications.

Each of the first extension part and the second extension part of the embodiment is formed of a resin material. In contrast, each of the first extension part and the second extension part may be formed of a metal material. For example, at least one of the first extension part and the second extension part may be formed of the resin material. For example, the forming material of each extension part can be changed according to design specifications.

The first extension part and the second extension part of the embodiment are supported at a position farther from the conveyance path than the end part facing the conveyance path in the support section. In contrast, the first extension part and the second extension part may be supported at the end part facing the conveyance path in the support section. For example, the support mode of the first extension part and the second extension part in the support section can be changed according to design specifications.

In the embodiment, the angle formed between the contact surface where the second extension part contacts the sheet and the conveyance surface when viewed from the orthogonal direction is 30 degrees or less. In contrast, the angle formed between the contact surface and the conveyance surface when viewed from the orthogonal direction may be more than 30 degrees. For example, the angle formed between the contact surface where at least one of the first extension part and the second extension part contacts the sheet and the conveyance surface when viewed from the orthogonal direction may be 30 degrees or less. For example, the angle formed between the contact surface and the conveyance surface when viewed from the orthogonal direction can be changed according to design specifications.

According to at least one embodiment described above, the gate includes the first extension part and the second extension part. A plurality of first extension parts are disposed at intervals in the direction orthogonal to each of the normal direction of the stack surface and the conveyance direction. The second extension part is disposed so as to close spacing between two adjacent first extension parts in the orthogonal direction. With this configuration, the sheet can be prevented from being caught during sheet movement.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

APPENDIX 1

A sheet processing device including:

a guide that is provided with a conveyance surface along a conveyance direction of a sheet, a support section configured to form a conveyance path of the sheet together with the guide, a stacker that is provided with a stack surface that supports a surface of the sheet conveyed through the conveyance path, and a gate that is configured to be able to receive the sheet into the stacker, and includes a plurality of first extension parts disposed at intervals in a direction orthogonal to each of a normal direction of the stack surface and the conveyance direction and a second extension part disposed so as to close spacing between two of the adjacent first extension parts in the orthogonal direction.

APPENDIX 2

The device according to Appendix 1, wherein a portion of at least one of the first extension part and the second extension part facing the conveyance path is softer than a portion thereof overlapping with the support section.

APPENDIX 3

The device according to Appendix 1 or 2, wherein the first extension part and the second extension part are configured by disposing two portions having different lengths adjacent to each other in the orthogonal direction.

APPENDIX 4

The device according to Appendix 3, wherein one of the two portions having different lengths overlaps with an end part of the conveyance surface when viewed from the stack surface and is provided with a leading end downstream in the conveyance direction, and the other of the two portions having different lengths has a leading end upstream of the one in the conveyance direction when viewed from the stack surface.

APPENDIX 5

The device according to any one of Appendixes 1 to 4, wherein the conveyance surface and the stack surface are inclined so as to approach each other as the conveyance surface and the stack surface go downward in a vertical direction when viewed from the orthogonal direction.

APPENDIX 6

The device according to any one of Appendixes 1 to 5, wherein at least one of the first extension part and the second extension part is formed of a resin material.

APPENDIX 7

The device according to any one of Appendixes 1 to 6, wherein the first extension part and the second extension part are supported at a position farther from the conveyance path than an end part facing the conveyance path in the support section.

APPENDIX 8

The device according to any one of Appendixes 1 to 7, wherein the first extension part and the second extension part are integrally formed of the same member.

APPENDIX 9

The device according to any one of Appendixes 1 to 8, wherein the first extension part and the second extension part are disposed such that end edges thereof in the orthogonal direction overlap with each other when viewed from the conveyance direction.

APPENDIX 10

The device according to any one of Appendixes 1 to 9, wherein, when viewed from the orthogonal direction, an angle between a contact surface where at least one of the first extension part and the second extension part contacts the sheet and the conveyance surface is 30 degrees or less.

What is claimed is:

1. A sheet processing device comprising:

a guide provided with a conveyance surface along a conveyance direction of a sheet;

a support section configured to form a conveyance path of the sheet together with the guide;

a stacker provided with a stack surface that supports a surface of the sheet conveyed through the conveyance path; and a gate configured to be able to receive the sheet into the stacker, and including (i) a plurality of first extension parts disposed at intervals in a direction orthogonal to each of a normal direction of the stack surface and the conveyance direction, and (ii) a second extension part disposed so as to close spacing between two of the adjacent first extension parts in the orthogonal direction.

2. The device according to claim 1, wherein a portion of at least one of the first extension part and the second extension part facing the conveyance path is softer than a portion thereof overlapping with the support section.

3. The device according to claim 1, wherein the first extension part and the second extension part are configured by disposing two portions having different lengths adjacent to each other in the orthogonal direction.

4. The device according to claim 3, wherein (i) one of the two portions having different lengths overlaps with an end part of the conveyance surface when viewed from the stack surface and is provided with a leading end downstream in the conveyance direction, and (ii) the other of the two portions having different lengths has a leading end upstream of the one in the conveyance direction when viewed from the stack surface.

5. The device according to claim 1, wherein the conveyance surface and the stack surface are inclined so as to approach each other as the conveyance surface and the stack surface go downward in a vertical direction when viewed from the orthogonal direction.

6. The device according to claim 1, wherein at least one of the first extension part and the second extension part is formed of a resin material.

7. The device according to claim 1, wherein the first extension part and the second extension part are supported at a position farther from the conveyance path than an end part facing the conveyance path in the support section.

8. The device according to claim 1, wherein the first extension part and the second extension part are integrally formed of the same member.

9. The device according to claim 1, wherein the first extension part and the second extension part are disposed such that end edges thereof in the orthogonal direction overlap with each other when viewed from the conveyance direction.

10. The device according to claim 1, wherein, when viewed from the orthogonal direction, an angle between a contact surface where at least one of the first extension part and the second extension part contacts the sheet and the conveyance surface is 30 degrees or less.

* * * * *